US005544941A

United States Patent [19]

Campbell et al.

[11] Patent Number: 5,544,941

[45] Date of Patent: Aug. 13, 1996

[54] ADJUSTABLE FOOT REST

[75] Inventors: James K. Campbell, Sandwich; Ned C. Pfeiffer, Chicago, both of Ill.; Nicola Balderi, Bloomfield Hills; Doug G. Schaefer, Taylor, both of Mich.

[73] Assignee: Fellowes Manufacturing Company, Itasca, Ill.

[21] Appl. No.: 337,177

[22] Filed: Nov. 10, 1994

[51] Int. Cl.[6] ..... A47C 16/00

[52] U.S. Cl. ..... 297/423.45; 297/463.1

[58] Field of Search ..... 297/423.1, 423.39, 297/423.41, 423.42, 423.44, 423.45, 423.46, 344.18, 344.19, 338, 339, 463.1; 248/188.5, 616, 371, 161, 404; 108/8, 1

[56] References Cited

U.S. PATENT DOCUMENTS

| | | | |
|---|---|---|---|
| 1,362,692 | 12/1920 | Goldstein | 297/423.42 X |
| 1,740,267 | 12/1929 | Remington | 297/423.46 X |
| 2,055,715 | 9/1936 | Barker | 248/616 X |
| 2,170,724 | 8/1939 | Marquardt | 297/423.45 X |
| 2,248,369 | 7/1941 | Ludersen | 297/423.45 X |
| 2,473,947 | 6/1949 | Hamstrom | 297/423.45 |
| 2,528,331 | 10/1950 | Bell | 297/423.46 |
| 2,935,120 | 5/1960 | Naus | 297/344.18 X |
| 4,441,758 | 4/1984 | Fleischer et al. | 297/423.46 |
| 5,201,568 | 4/1993 | Christensen, Jr. | 297/423.46 |

OTHER PUBLICATIONS

Pp. 80 and 81 from the Apr. 1993 Global catalog (U.S.A.).
Pp. 7, 64 and 65 from an undated Misco catalog (U.S.A.).
P. 257 from an undated Quill catalog showing foot rests. (U.S.A.).
P. 76 from a Global 1994 catalog showing foot rests (U.S.A.).
P. 548 from a Boise 1994 Office Products Catalog showing foot rests (U.S.A.).

*Primary Examiner*—Milton Nelson, Jr.
*Attorney, Agent, or Firm*—G. Peter Nichols; Willian Brinks Hofer; Gilson & Lione

[57] ABSTRACT

A foot rest is provided with a platform that can be vertically adjusted and tilted by the user using only their feet. The foot rest includes a base with a support, a tilt column that cooperates with a locking assembly, and a platform. The locking assembly can be actuated by the user's foot to vary the vertical height of the platform. The platform is slidably engaged to the tilt column to allow the user to vary the inclination of the platform from the horizontal independently of the vertical adjustment.

16 Claims, 3 Drawing Sheets

ADJUSTABLE FOOT REST

BACKGROUND OF THE INVENTION

The present invention relates to an adjustable foot rest, in particular to a foot rest that can be adjusted vertically as well as tilted. More particularly, the present invention relates to an adjustable foot rest that can be adjusted solely through the use of the user's feet.

There is an increasing awareness to provide office furniture and accessories that are comfortable and ergonomic. In this regard, foot rests useful for underneath a work surface such as a desk are becoming more prevalent. To minimize the cost of manufacture, it would be desirable to be able to adjust the foot rest so that a single foot rest can be used by any number of people. It is also desirable to be able to adjust the inclination of the foot rest from the horizontal to provide differing heights upon which a user can rest their feet. It is also desirable to provide a foot rest that can be adjusted solely by using one's feet so that the user does not have to crawl underneath the desk to adjust the foot rest. The present invention solves these needs by providing a foot rest having a foot platform that can be vertically adjusted and tilted by the user using only their feet.

SUMMARY OF THE INVENTION

The present invention provides a foot rest having a foot platform that can be vertically adjusted as well as tilted independently of each other. The foot rest includes a base having a support, a tilt column that surrounds the support, a spring disposed within the support to bias the tilt column in an upward direction, a locking assembly to lock the tilt column at various discrete vertical heights, and a foot platform slidably attached to the tilt column such that the inclination of the foot platform can be varied independently of the vertical height adjustment of the tilt column.

The base rests on the floor and has a support extending upward from its top surface. Preferably, the base has at least two feet to support the base such that the bottom of the base is spaced from the floor. The support may have any desirable shape but is preferably substantially rectangular, i.e, the support has four upward extending walls. In this preferred embodiment, the support has at least one horizontal slot near the distal end of at least one wall. Most preferably, a horizontal slot is provided near the distal end of each wall.

The tilt column has a top and a bottom with the bottom being open and shaped to surround the support. In the preferred embodiment where the support is rectangular, the walls of the tilt column may be provided with a plurality of spaced apart horizontal slots that align with the slot provided on the support. Alternatively, adjusting plates having a plurality of spaced apart horizontal slots that align with the slot provided on the support may be attached to the inside of the walls of the tilt column. In the preferred embodiment, the top of the tilt column is provided with a pair of convexly curved flanges on opposite sides of the tilt column. The flanges have a longitudinal slot extending substantially the entire length of the flange to slidably receive the foot platform. The foot platform is provided with a top and a bottom with the bottom slidably attached to the top of the tilt column.. In the preferred embodiment, the platform is slightly convexly curved to provide comfort to various users. The top of the platform may have a layer of resilient material to provide further comfort to the user's feet. Preferably, the bottom of the platform has a pair of complementary shaped convex flanges that slide against the convexly shaped flanges of the tilt column. In this way, as the platform moves with respect to the tilt column, the inclination of the platform can be varied. In the most preferred embodiment, the platform is slidably attached to the tilt column by a pair of tilt adjusting assemblies. The tension of the tilt adjusting assemblies can be varied so that the difficulty of inclining the platform can be varied.

To adjust the vertical height of the platform, a spring is disposed within the support to bias the tilt column and thus the platform in an upward direction. A locking assembly is provided to cooperate with the slots in the support and the tilt column (or adjusting plates, if present) to lock the tilt column at various discrete vertical heights. Preferably, the locking assembly includes a plate having teeth that extend through the slots on the support and the slots on the tilt column (or adjusting plates, if present) to lock the tilt assembly from further upward movement. A lever that cooperates with the plate extends beyond the base so that as the user moves the lever with their foot, the teeth will rotate from a position extending through the slots to a position withdrawn from the slots.

DETAILED DESCRIPTION OF THE INVENTION AND PREFERRED EMBODIMENTS

Figure 1:
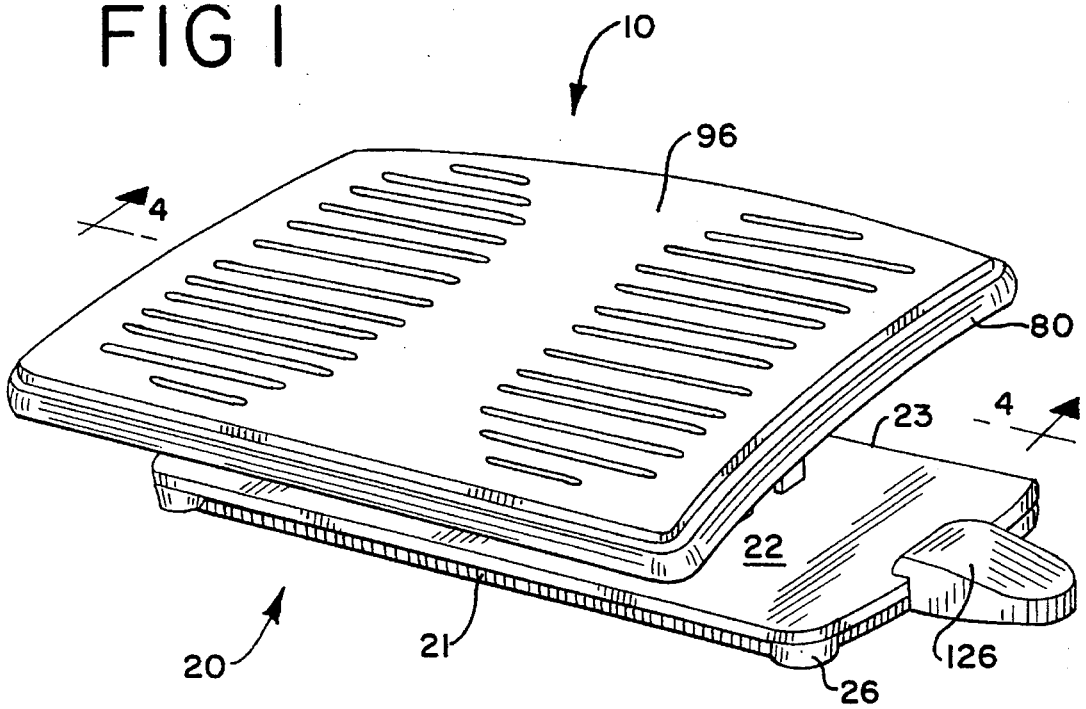
FIG. 1 is a front perspective view of the foot rest with the platform in a lowered position.
Figure 2:
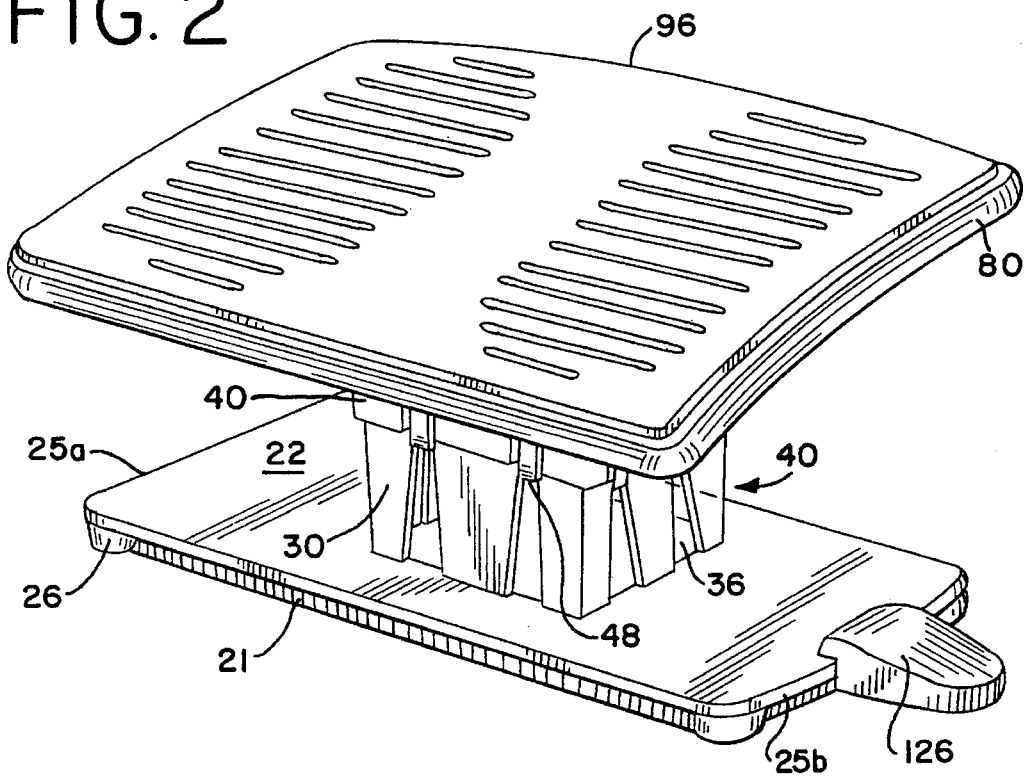
FIG. 2 is a front perspective view of the foot rest with the platform in a raised position.
Figure 3:
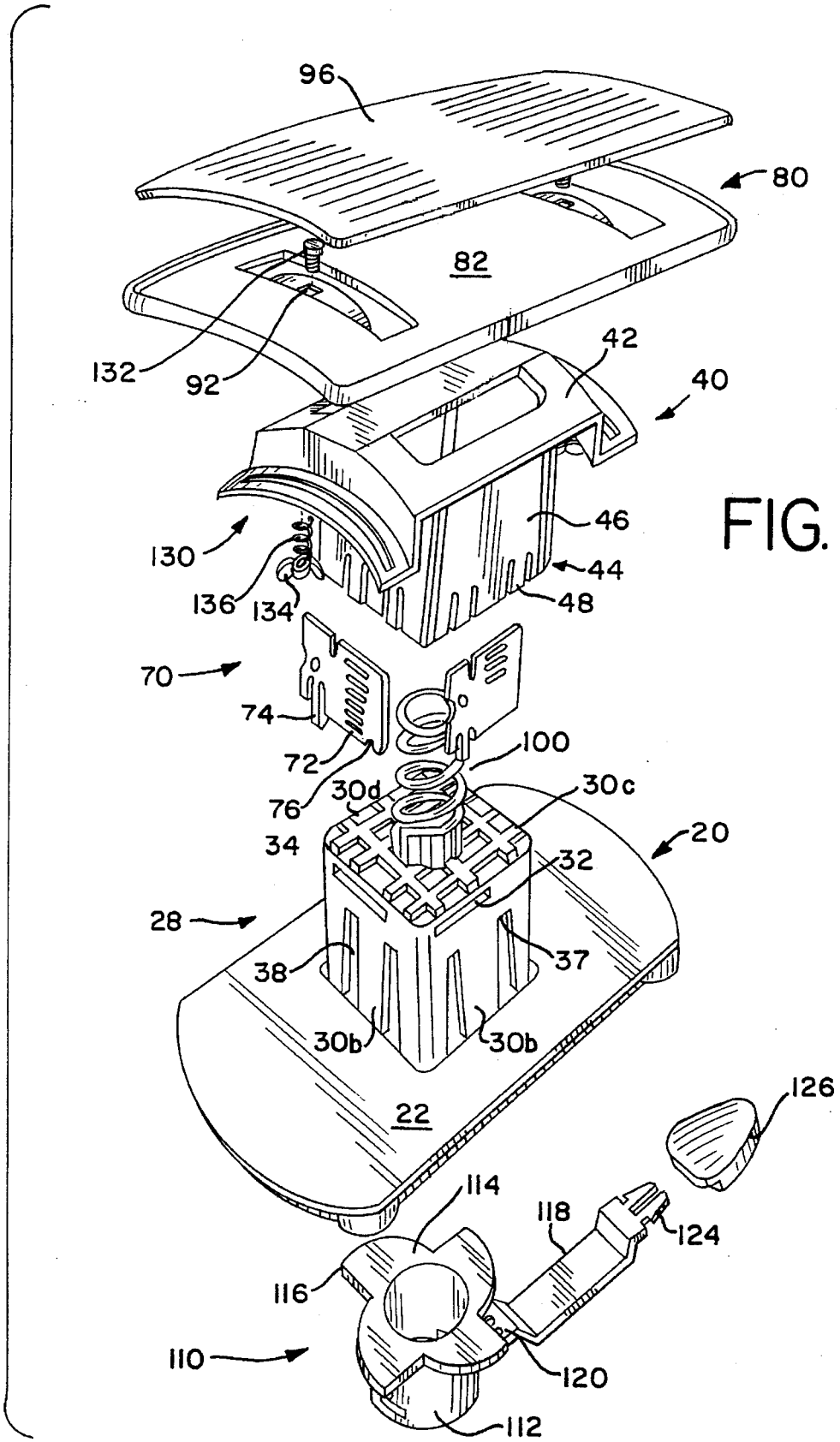
FIG. 3 is an exploded view of the foot rest of FIG. 1.
Figure 4:
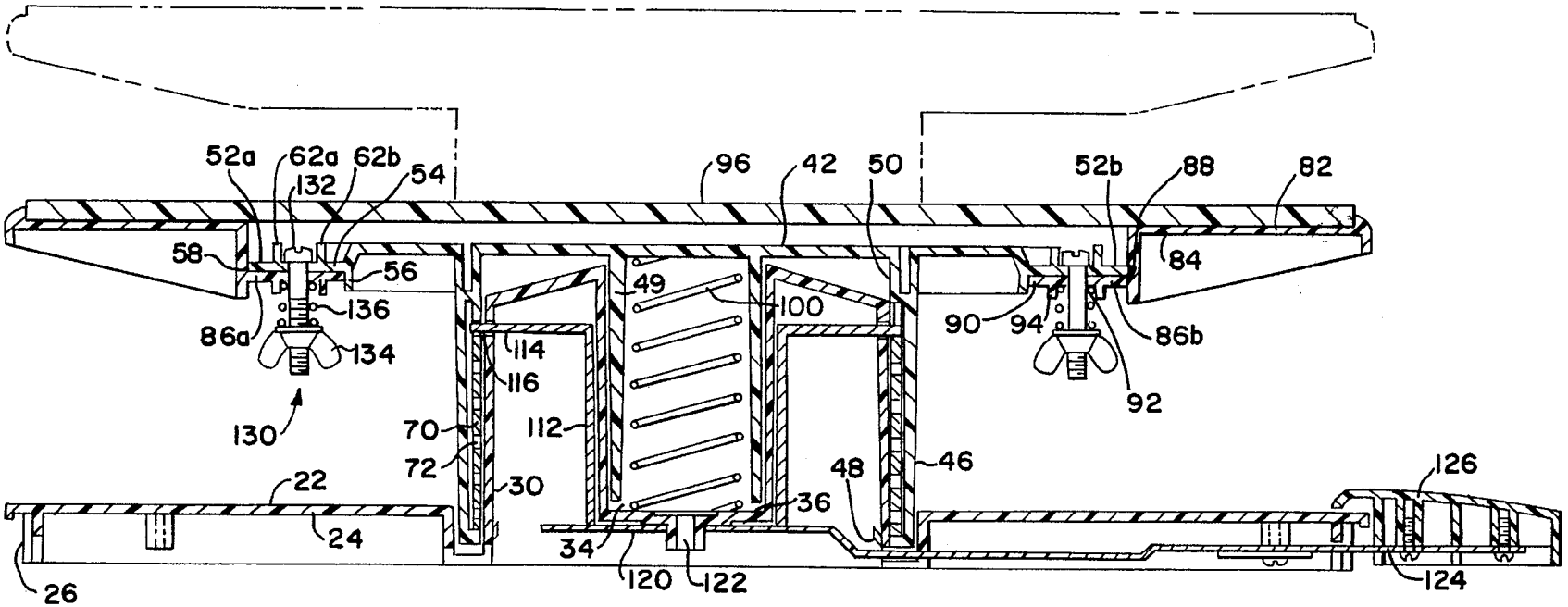
FIG. 4 is a cross-sectional view of the foot rest of FIG. 1 along line 4—4.

The foot rest 10 of the present invention includes a base 20 having an upward extending support 28, a tilt column 40 that cooperates with the support, and a foot platform 80 slidably attached to the tilt column. A main spring 100 is disposed within the support to bias the tilt column and thus the platform in an upward direction. A locking assembly 110 cooperates with the support and the tilt column so that the vertical height of the tilt column can be adjusted at discrete intervals. A tilt adjustment assembly 130 cooperates with the tilt column and the platform so that the difficulty of adjusting the inclination of the platform can be varied by the user. In this way, the vertical height of the foot platform can be varied independently of any adjustment to the inclination of the platform.

The base 20 includes a top 22 and a bottom 24. The bottom may rest upon the floor. Preferably, however, the bottom is spaced from the floor by providing, for example, spaced apart feet 26. The feet may be provided with rubber ends to minimize unwanted movement.

The base may have any shape and dimension as is desired by, among other things, manufacturing and consumer preferences. Preferably, the base is substantially rectangular shaped. When the base is substantially rectangular shaped and in use, a front 21, a rear 23, and two sides 25*a*, 25*b* of the base may be defined. In use, the front 21 will be that portion of the base closest to the user. Of course, when the base is rectangular, it may be symmetrical so that the rear is the same as the front.

A support 28 is attached to and extends upward from the top of the base. Preferably, the support is integral with the base. The support may have any suitable shape and dimension, but is preferably rectangular shaped and is smaller than the base so that it can be located in the approximate center of the base. In this preferred embodiment where the support is rectangular shaped, there are four walls 30*a*, 30*b*, 30*c*, and 30*d* that extend upward at their upper ends, the walls converge inward and downward to define an inner chamber 34 having a closed bottom 36 within which a main spring 100 is disposed. The inner chamber may have any suitable shape to contain the spring 100, which is preferably helical. The inner chamber is preferably substantially cylindrical with a closed bottom.

At least one horizontal slot 32 is provided on at least one of the walls. Preferably, the slot is provided near the upper or distal end of the wall. The slot 32, however, can be provided on any or all of the walls. In the most preferred embodiment, one horizontal slot is provided near the distal end of each wall.

At least one vertical slot 38 is provided on at least one of the walls 30 to cooperate with the tilt column in a manner that is described below. The slot extends from the bottom of the wall upward toward the horizontal slot 32 and terminates at a stop 37. Preferably, at least one vertical slot 38 is provided on each of the walls 30. In the most preferred embodiment, two spaced apart vertical slots are provided on each of the walls.

The tilt column 40 has a top 42 and an open bottom 44 that surrounds the support. Since the bottom of the tilt column surrounds the support, it has substantially the same dimensions as the support, and therefore is preferably rectangular and has four walls 46 extending downward from the top 42. The distal end of at least one of the walls has a hook 48 that extends into the vertical slot 36. The hook prevents the tilt column from being separated from the support. If the tilt column is not locked, the spring will bias the tilt column upward until the spring is fully extended. It is desirable, however, to prevent full extension of the spring. The hook 48, therefore, contacts the stop 37 of the vertical slot 36 before the spring is fully extended to prevent the tilt column from being forced out of contact with the support. Any or, most preferably, all of the walls 46 have an identical hook 48 at their distal end.

The top 42 of the tilt column preferably has downward extending walls 49 that extend into the chamber 34 defined by the support. As a result, the walls 49 conform in shape with the shape of the chamber 34. In this way a closed chamber for containing the main spring 100 is provided.

The top 42 of the tilt column is preferably convexly curved in the direction from the rear of the base toward the front of the base, The top has at least one, and preferably two flanges 52*a*, 52*b* extending outward toward the sides 25*a* and 25*b* of the base. The flanges are convexly curved from the rear of the base toward the front and have a longitudinal slot 60 that cooperates with a tilt adjusting mechanism.

In the most preferred embodiment, the longitudinal slot 60 has a pair of opposed upward extending lips 62*a* and 62*b* on each lateral side of the slot. The lips aid in positioning the tilt adjustment assembly. In this most preferred embodiment, the proximal end 54 of each flange has a downward extending stop 56 that contacts a flange 86 on the platform so that the platform will be correctly aligned on the tilt column.

Alternatively, the top of the tilt column may be provided with a longitudinal slot to cooperate with the platform and a tilt adjusting assembly. In this embodiment, the platform may be provided with an aperture that is aligned with the longitudinal slot on the tilt column. The tilt adjusting mechanism described below can then be used in cooperation with the aperture and longitudinal slot.

The foot platform 80 is slidably attached to the top of the fit column. The platform is preferably convexly curved to provide various inclinations upon which the user can comfortably rest their feet. The platform includes a top 82 and a bottom 84. The top 82 may be covered with a resilient material 96 such as foam, rubber, carpet and the like to provide further comfort for the user. The top 82 may also be formed or molded with dimples or bumps to provide a massaging feeling to the user's feet.

The bottom 84 is slidably attached to the top of the tilt column, and preferably to the flanges 52. The bottom 84 has at least one, and preferably two flanges 86*a* and 86*b* extending inward toward the support on the base to a position underneath and adjacent the flanges 52*a* and 52*b*, respectively. The flanges 86*a*, 86*b* are preferably convexly curved from the rear to the front of the base so that the platform can easily slide along the flanges 52.

The distal end 58 of the convex flanges on the tilt column contact the proximal end of the flange 86 on the platform. The distal end 90 of the flanges on the platform contacts the stops 56 so that the platform is properly positioned on the tilt column. In addition, each flange 86 has at least one aperture that is aligned with the longitudinal slot on the flange 52 to receive the tilt adjustment assembly.

To secure the platform to the tilt column, at least one tilt adjusting assembly 130 is provided. Preferably, two tilt adjusting assemblies are provided with one assembly cooperating with flanges 52*a*, 86*a* and with the other assembly cooperating with flanges 52*b*, 86*b*. It may be desired to provide two tilt adjusting assemblies to cooperate with flanges 52*a*, 86*a* and two tilt adjustment assemblies to cooperate with flanges 52*b*, 86*b*. Of course it will be appreciated that by providing two assemblies for each side, the range of inclination obtained by the platform is decreased.

Most preferably, each tilt adjusting assembly includes a bolt 132, a nut 134, and a spring 136. The bolt 132 extends through the longitudinal slot 60 on the flange 52 and the aligned aperture 92 in the flange 86 and then threadably receives a nut 134. A spring 136 is disposed between the nut 134 and the flange 86 on the platform to provide tension to hold the platform to the tilt column and to increase the friction between them. Since the flanges 86*a*, 86*b* are underneath the flanges 52*a*, 52*b* of the tilt column downward pressure on the platform will compress the spring allowing the platform to slide with respect to the tilt column.

To increase the tension, the nut is rotated toward the platform so that it becomes more difficult to slidably move the platform with respect to the support. To decrease the tension, the nut is rotated away from the platform so that it becomes easier to slidably move the platform with respect to the support. Once the desired tension is set, the user puts pressure on the platform with their foot and then they can slide the platform with their feet to adjust the platform to a desired inclination. The platform can be moved until the bolt 132 contacts the end of the longitudinal slot. Therefore, the range of inclination will be determined by the length of the longitudinal slot 60 and the location of the aperture To adjust the vertical height of the foot platform, preferably at least one adjusting plate 70 is provided with at least one horizontal slot 72 to cooperate with the tilt column, the slots 32 on the support and a locking assembly 1 Most preferably, four adjusting plates are provided. Each adjusting plate 70 is positioned between the inner surface of the wall 46 of the tilt column and the outer surface of the wall 30 of the support.

In a preferred embodiment, at least one of the walls has a guide 50 at its proximal end to secure an adjusting plate 70. In the most preferred embodiment, each of the walls has a guide 50 at its proximal end to secure an adjusting plate. Each plate 70 is therefore securely retained adjacent the inner surface of the wall 46 by the proximal end of the hook 48 and the guide 50. Since the walls of the support and the tilt column are rectangular, each adjusting plate is also rectangular and has a plurality of spaced apart horizontal slots 72 that align with the slots 32 on the support.

At least one of the adjusting plates has a hook 74 at its lower end to cooperate with a vertical slot on the support. More preferably, each adjusting plate has a hook 74 that extends into the vertical slot on the support to restrict upward movement of the tilt column. In the most preferred embodiment, the hook 74 is located to one side of the plate such that when the plate is secured in position, the hook 48 on the wall of the tilt column is on the other side of the plate. In this most preferred embodiment, the bottom of the adjusting plate has a notch 76 to receive the hook 48 on the tilt column. It will be understood that, in use, in the most preferred embodiment, the hook 74 on each adjusting plate will engage one vertical slot on the wall 46 while the hook 48 on the tilt column will engage the other vertical slot on the same wall.

Alternatively, the walls 46 of the tilt column may be provided with a plurality of spaced apart horizontal slots that will align with the horizontal slot 32 provided on the support and cooperate with the locking mechanism so that the vertical height of the tilt column can be adjusted to various discrete heights. In this embodiment it will be understood that no adjusting plates will be necessary.

As noted above, a main spring 100 is disposed within the chamber 34 and contacts the inside of the top of the tilt column to bias the tilt column and thus the platform in an upward direction. To lock the tilt column at various discrete vertical heights, a locking assembly 110 is provided. The locking assembly 110 includes an extension 112 having a bottom and a plate 114 at the top that engages at least one of the aligned slots 32 on the support and slots 72 on the adjusting plate. Preferably, the plate includes at least one tooth 116, more preferably two teeth opposite each other and, most preferably four teeth. When the extension is rotated in one direction the teeth extend through the aligned slots 32 and 72 to lock the tilt column and thus the platform at a discrete vertical height. When the extension is rotated in another opposite direction, the teeth are withdrawn from the aligned slots 32 and 72 so that the spring biases the tilt column and thus the platform in an upward direction until the hooks on the tilt column and adjusting plate contact the stop 37 on the vertical slots 36. 0f course, if weight is loaded on the top of the platform the spring may be depressed. For example, if a user pushes downward on the platform with their foot the spring will be compressed.

A lever 118 having a first end 120 and a second end 124 is provided to rotate the plate. The first end is attached to the extension 112 by an attaching means 122 such as a bolt and nut. The lever most preferably extends from the extension toward one side of the base so that the second end extends beyond the side of the base. Alternatively, the lever may extend toward the front of the base so that the second end extends beyond the front of the base. The second end may be provided with a cover 126.

If desired the locking assembly 110, including the extension 112, the plate 114, and the lever may be molded from plastic as a single piece.

In the most preferred embodiment, the bottom of the base is spaced from the floor so that the lever can be easily moved. As the second end 124 is moved from the front of the base toward the rear of the base, the lever is moved causing the extension and thus the plate to rotate. It may be desirable to shape the sides **25*a*, 25*b*** with a slight arc to assist the movement of the lever along the side edge. In a like manner, as the second end is moved from the rear of the base toward the front of the base, the lever is moved causing the extension and thus the plate to rotate. As a result, the vertical height of the platform can be varied by moving the second end of the lever. In the most preferred embodiment, the second end receives a pedal. It is to be understood that the lever may have a locking position in the center of its travel or at either end, and that the direction of movement to lock and unlock the assembly may be varied.

It will be appreciated by one skilled in the art, that the user can vertically adjust the height of the platform simply by using their feet. For example, to raise the vertical height of the platform, the user using one foot moves the lever from a position near the front toward the rear of the base so that the teeth on the plate are withdrawn from the aligned slots 32 and 72 causing the spring to bias the tilt column and thus the platform in an upward direction. The user can then control whether the platform is raised or lowered by simply placing their other foot on the platform to either allow the platform to move upward or to force the platform downward. When the platform is in the position desired by the user, the user moves the lever back to a position near the front of the base. At the same time and independently of the vertical adjustment, the user may use their foot to slide the platform to a desired inclination.

Although the foot rest has been described as having both height and tilt adjustment it is contemplated that the foot rest may have only height adjustment or only tilt adjustment° To provide only height adjustment, the top of the tilt column may be formed to provide a foot platform. To provide only tilt adjustment the support may be provided with flanges to cooperate with the flanges on the foot platform. In this case there would be no tilt column.

Of course, it should be understood that a wide range of changes and modifications can be made to the embodiments described above. It is therefore intended that the foregoing description illustrates rather than limits this invention, and that it is the following claims, including all equivalents, which define this invention.

We claim:

1. A foot rest comprising:

a. a base with an upward extending support;

b. a tilt column surrounding the support and having a convexly curved top portion with the top portion having at least one convexly curved flange; and, c. a platform slidably attached to the flange on the tilt column such that the platform can be inclined.

2. The foot rest of claim 1 wherein the platform further has at least one convexly curved flange disposed below the flange on the tilt column.

3. The foot rest of claim 1 wherein the top portion of the tilt column further has a first convexly curved tilt column flange provided on a first lateral side and a second convexly curved tilt column flange provided on a second lateral side;

and wherein the platform has a top and a bottom with the bottom further having a first platform flange provided on a first lateral side, the first platform flange disposed below and slidably contacting the first tilt column flange and a second platform flange provided on a second lateral side, the second platform flange disposed below and slidably contacting the second tilt column flange.

4. The foot rest of claim 3 further having a tilt adjusting assembly to cooperate with at least one of the first and second tilt column flanges and one of the first and second platform flanges, the tilt adjusting assembly comprising:

a. a bolt extending through at least one of the tilt column and platform flanges;

b. a nut threadable received on the bolt;

c. a spring disposed between the platform flange and the nut whereby the tilt column and platform flanges are biasedly engaged and such that pressure on the platform toward the base permits slidable movement of the platform with respect to the tilt column.

5. The foot rest of claim 1 further having a tilt adjusting assembly to cooperate with the at least one flange and the platform whereby ease of sliding of the platform with respect to the tilt column can be varied.

6. The foot rest of claim 5 wherein the tilt adjusting assembly includes a spring to bias the at least one flange and the platform into substantial locking contact whereby pressure on the platform toward the base permits movement of the platform with respect to the tilt column so that the platform can be inclined.

7. A foot rest comprising:

a. a base with an upward extending support, b. a tilt column surrounding the support and having a convexly curved top portion with the top portion having at least one convexly curved tilt column flange;

c. a spring received within the support to bias the tilt column in an upward position; and, d. a locking assembly having a portion that extends into the support to lock the tilt column in at least two differing vertical heights; and, e. a platform slidably attached to the top portion of the tilt column such that the platform can be inclined.

8. The foot rest of claim 7 wherein the platform further has at least one convexly curved platform flange disposed below the tilt column flange.

9. The foot rest of claim 7 wherein the top portion of the tilt column has a first convexly curved tilt column flange provided on a first lateral side of the top portion and a second convexly curved tilt column flange provided on a second lateral side;

and wherein the platform has a top and a bottom with the bottom further having a first platform flange provided on a first lateral side, the first platform flange disposed below and slidably contacting the first tilt column flange and a second platform flange provided on a second lateral side, the second platform flange disposed below and slidably contacting the second tilt column flange.

10. The foot rest of claim 9 further having a tilt adjusting assembly to cooperate with at least one of the first and second tilt column flanges and one of the first and second platform flanges, the tilt adjusting assembly comprising:

a. a bolt extending through at least one of the tilt column and platform flanges b. a nut threadably received on the bolt;

c. a spring disposed between the platform flange and the nut whereby the tilt column and platform flanges are biasedly engaged.

11. The foot rest of claim 7 further having a tilt adjusting assembly to cooperate with the at least one flange and the platform whereby ease of sliding of the platform with respect to the tilt column can be varied.

12. The foot rest of claim 11 wherein the tilt adjusting assembly includes a spring to bias the at least one flange and the platform into substantial locking contact whereby pressure eon the platform toward the base permits movement of the platform with respect to the tilt column so that the platform can be inclined.

13. The foot rest of claim 7 wherein the locking assembly includes a lever extending outwardly of the base whereby the lever can be rotated to lock the tilt column in at least a first vertical height and a second vertical height different from the first vertical height.

14. The foot rest of claim 7 further comprising:

a. at least one horizontal slot disposed on the support;

b. an adjusting plate disposed between the support and the tilt column and associated with the tilt column, the plate having at least one horizontal slot, whereby the locking assembly cooperates with each horizontal slot to lock the tilt column.

15. The foot rest of claim 14 wherein the locking assembly comprises:

a. an extension having a top and a bottom with the top having at least one tooth; and, b. a lever connected to the bottom of the extension and extending outwardly of the base whereby the tooth can be rotated from a first position where it extends through the horizontal slot on the adjusting plate and the horizontal slot on the support and locks the tilt column to a second position where it does not extend through the horizontal slot.

16. A foot rest comprising:

a. a base with an upward extending support, the support having at least one horizontal slot;

a tilt column surrounding the support;

c. a spring received within the support to bias the tilt column in an upward position;

d. an adjusting plate disposed between the support and the tilt column and associated with the tilt column, the plate having at least one horizontal slot; and, e. a locking assembly comprising:

i. an extension having a top and a bottom with a top having at least one tooth; and ii. a lever connected to the bottom of the extension and extending outwardly of the base whereby the one tooth can be rotated from a first position where it extends through the horizontal slot on the adjusting plate and the horizontal slot on the support and locks the tilt column to a second position where it does not extend through the horizontal slots.

* * * * *